US011486153B2

(12) United States Patent
Haeberle

(10) Patent No.: US 11,486,153 B2
(45) Date of Patent: Nov. 1, 2022

(54) FRAME STRUCTURE FOR A FORMWORK PANEL

(71) Applicant: Peri SE, Weissenhorn (DE)

(72) Inventor: Wilfried Haeberle, Langenau (DE)

(73) Assignee: PERI AG, Weissenhorn (DE)

( * ) Notice: Subject to any disclaimer, the term of this patent is extended or adjusted under 35 U.S.C. 154(b) by 0 days.

(21) Appl. No.: 16/827,508

(22) Filed: Mar. 23, 2020

(65) Prior Publication Data

US 2020/0325693 A1 Oct. 15, 2020

(30) Foreign Application Priority Data

Mar. 22, 2019 (DE) ..... 10 2019 107 433.9

(51) Int. Cl.
*E04G 9/02* (2006.01)
*E04G 11/38* (2006.01)
*E04G 11/48* (2006.01)

(52) U.S. Cl.
CPC ..... *E04G 9/02* (2013.01); *E04G 11/38* (2013.01); *E04G 11/486* (2013.01); *E04G 2009/028* (2013.01)

(58) Field of Classification Search
CPC ..... E04G 11/10; E04G 11/12; E04G 9/02; E04G 2009/025; E04G 2009/028; E04G 11/38; E04G 11/483; E04G 11/486; E04G 11/48; E04G 11/50
USPC ..... 52/506.07, 837, 846
See application file for complete search history.

(56) References Cited

U.S. PATENT DOCUMENTS 9,004,443 B2 * 4/2015 Zhang ..... E04G 17/00 249/18
9,861,190 B2 * 1/2018 Lee ..... E04G 17/04
2002/0117596 A1 * 8/2002 McCracken ..... E04G 9/06 249/44

FOREIGN PATENT DOCUMENTS

| | | | | |
|---|---|---|---|---|
| AT | 10946 U1 * | 1/2010 | ..... | E04G 9/02 |
| CA | 3030060 A1 * | 1/2018 | ..... | E04G 11/36 |
| DE | 1957385 A1 * | 5/1971 | ..... | E04G 9/02 |
| DE | 3606320 A1 * | 9/1987 | ..... | E04G 9/02 |
| DE | 4122173 A1 * | 1/1993 | ..... | E04G 9/02 |
| DE | 4339554 A1 * | 5/1995 | ..... | E04G 9/02 |
| DE | 102018106221 A1 * | 9/2019 | ..... | E04G 9/05 |
| EP | 1375781 B1 | 1/2004 | | |
| EP | 3438365 A1 * | 2/2019 | ..... | E04G 11/483 |

(Continued)

OTHER PUBLICATIONS

Translation of DE 3606320. (Year: 1987).*

(Continued)

*Primary Examiner* — Michael Safavi
(74) *Attorney, Agent, or Firm* — Wei & Sleman LLP

(57) ABSTRACT

A support structure for a formwork panel having a support structure and a formwork skin positioned on the front of the support structure and attached to the support structure, wherein the support structure has at least one edge girder on a pair of opposite edges and a plurality of transverse girders between these two edge girders which run transversely to these two edge girders, characterized in that at least some of the transverse girders are designed as a profile girder, comprising a flange at its first end arranged at the front of the support structure, a tubular hollow section at its second end away from the front of the support structure, and between them a preferably wall-like member connecting the first end and the second end.

17 Claims, 3 Drawing Sheets

(56) References Cited

FOREIGN PATENT DOCUMENTS

| | | | | | |
|---|---|---|---|---|---|
| EP | 3470603 | A1 | * | 4/2019 | ..... E04G 11/28 |
| FR | 297761 | A1 | | 1/2013 | |
| KR | 20150116373 | | | 10/2015 | |
| KR | 101722109 | B1 | * | 4/2017 | ..... E04G 9/02 |
| KR | 20180052268 | A | * | 5/2018 | ..... E04G 11/48 |
| KR | 20180119830 | A | * | 11/2018 | ..... E04G 9/10 |
| WO | 2013098158 | A1 | | 7/2013 | |
| WO | 2016139513 | A1 | | 9/2016 | |
| WO | WO-2018007420 | A1 | * | 1/2018 | ..... E04G 11/48 |
| WO | WO-2019023745 | A1 | * | 2/2019 | ..... E04G 9/04 |
| WO | WO-2019039699 | A1 | * | 2/2019 | ..... E04G 9/02 |

OTHER PUBLICATIONS

Translation of WO 2019039699. (Year: 2019).*
Translation of KR 20180119830. (Year: 2018).*
Tobler Deck AVA, Tobler AG (Published Mar. 2018).

* cited by examiner

FRAME STRUCTURE FOR A FORMWORK PANEL

FIELD OF THE INVENTION

The invention relates to a support structure for a formwork panel, which has a support structure and a formwork skin positioned at the front of the support structure and attached to the support structure, the support structure having at least one pair of opposite edges, one edge girder each and between these two edge girders, a plurality of transverse girders, which run transversely to these two edge girders, characterized in that at least some of the transverse girders are designed as a profile girder, comprising a flange at its first end arranged at the front of the support structure, a tubular hollow section at its second end away from the front of the support structure, and between them a preferably wall-like member connecting the first end and the second end.

The two edge girders and/or the transverse girders can be made of metal.

BACKGROUND OF THE INVENTION

Support structures for formwork panels constructed from metal girders are known in a large number of configurations. The transverse girders are often made of sheet metal, which has a cross-sectional shape that is produced by folding the sheet metal. Such transverse girders are comparatively inexpensive to manufacture but not optimal in a static sense, i.e., in terms of their load-bearing capacity relative to the weight of the transverse girder.

SUMMARY OF THE INVENTION

In the support structure according to the invention, however, at least some of the transverse girders are designed as profile girders with the features mentioned in the first paragraph. Such transverse girders are more difficult to manufacture, but their static performance, i.e., their load capacity relative to the weight of the transverse girder, is very good. The load-bearing capacity is defined primarily by the flange and the tubular pole section. The wall-like member can be made with a relatively small material thickness. The tubular hollow section makes the support structure and the formwork panel fashioned with this support structure easy to work with.

The expression "at least some of the transverse girders" means that either only one transverse girder or several transverse girders or all transverse girders of the formwork panel are configured in the manner referenced in the first paragraph.

The transverse girders can be welded to the two edge girders.

The invention provides for the possibility that the at least one profile girder is an extruded profile made from aluminum. The term "aluminum" as used in this application refers to unalloyed aluminum or for aluminum alloy. Extruded aluminum profiles can be produced comparatively easily and inexpensively. It is possible that the material thickness—seen in the cross-section of the profile girder—is not the same everywhere but can be selected in consideration of a static optimization.

In the support structure according to the invention as disclosed in the previous part of the description, the at least one profile girder may have a finger hole in the member or may have several finger holes over the length of the profile girder. Due to the finger hole or the finger holes, the support structure or the formwork panel fashioned with the support structure can be gripped and handled particularly well with the hands. In order to correctly determine the value of this statement, it is important to bear in mind that support structures or formwork panels made with these—depending on their size—have a considerable weight, the support structures or formwork panels have to be carried on the construction site for certain distances and in many cases the formwork panels have to be brought into an overhead position. With regard to all of these aspects, a high load-bearing capacity per structure weight or formwork panel weight, an aluminum construction and a static optimization of the transverse girders are advantageous.

There is the possibility of making said finger hole, or each of said finger holes, elongated in the longitudinal direction of the profile girder and delimiting it or them on the side adjacent to the hollow section by the hollow section for a large part of its (their) length. In other words, the respective finger hole ends on the relevant side where the hollow section of the transverse member profile begins, or shortly before. In this way, the respective finger hole merges into the outer contour of the hollow section. The workman encounters a situation in which the hand can comfortably and securely grasp a section of the support structure.

The flange of the respective profile girder referenced in the first paragraph can project on one or both sides of the member. It is possible for the flange to have a projection which increases the flange thickness at its projecting end or at its two projecting ends, wherein the projection is pointing forward in the direction of the front of the support structure and/or rearward in the direction of the rear of the support structure. The projection or projections bring additional material into the flange. The flange can therefore be made with a lower width. More than one projection can be provided per flange arm.

In the support structure according to the invention as disclosed in the previous part of the description, the hollow section of the profile girder can be substantially circular in the cross-section. An exact circular shape without "substantially" is possible as well. Other cross-sectional areas of the hollow section are also possible, specifically rectangular or square with rounded corners, triangular with rounded corners and oval with two axes of unequal length.

There are embodiments of the invention as disclosed in the previous part of the description in which the transverse girder profile has the following dimensions:

(a) the member has a thickness in the range 0.8 to 2.5 mm or in the range 0.8 to 2.0 mm, and/or (b) the member has a height in the range of 50 to 110 mm, and/or (c) the flange has a width in the range of 15 to 40 mm, and/or (d) the hollow section, measured outside and perpendicular to the central plane of the member, has a thickness in the range 15 to 30 mm, and/or (e) the wall thickness of the hollow section is 0.9 to 1.2 times the wall thickness of the member, and/or (f) the thickness of the flange, if applicable aside from the at least one projection, is 0.7 to 1.2 times the wall thickness of the member.

These dimensions were determined in consideration of their producibility, good material utilization and good shape retention of the respective transverse girder, in particular a girder made of aluminum, when the transverse member was cooling off after its extrusion at an elevated temperature.

These dimensions make particular sense if the respective profile girder made from aluminum is extruded.

The edge girders referenced in the first paragraph can be longitudinal edge girders of the support structure, with the support structure being longer in the longitudinal direction of these edge girders than in the transverse direction. The support structure according to the invention may comprise a preferably metallic edge girder (which can be a transverse edge girder) on a second pair of opposite edges, which extends transversely to the two edge girders of the first pair referenced in the first paragraph. If the support structure has transverse-edge girders, the term "transverse girder" referenced in the first paragraph should not include the transverse edge girders but only the transverse intermediate girders. Formwork panels that have a support structure with two longitudinal edge girders and two transverse edge girders are usually called frame formwork panels.

The edge girders of the support structure can be made of aluminum. The edge girders of the support structure can be extruded profiles.

The support structure according to the invention can be used for formwork panels for pouring concrete, in particular floor slab formwork panels. But it can also be used for other formwork, for example for the absorption of the lateral load of an earth slope or for a temporary underpinning of a ceiling structure during repair work.

Another object of the invention is a formwork panel comprising a support structure according to the invention as disclosed in the previous part of the description and a formwork skin attached to the support structure on the front of the support structure. The formwork panel can be a frame formwork panel. The formwork panel can be a ceiling formwork panel.

BRIEF DESCRIPTION OF THE DRAWINGS

The invention and more specific embodiments of the invention are explained in more detail below on the basis of exemplary embodiments illustrated in the drawings. The figures show the following.

DETAILED DESCRIPTION

Figure 1:
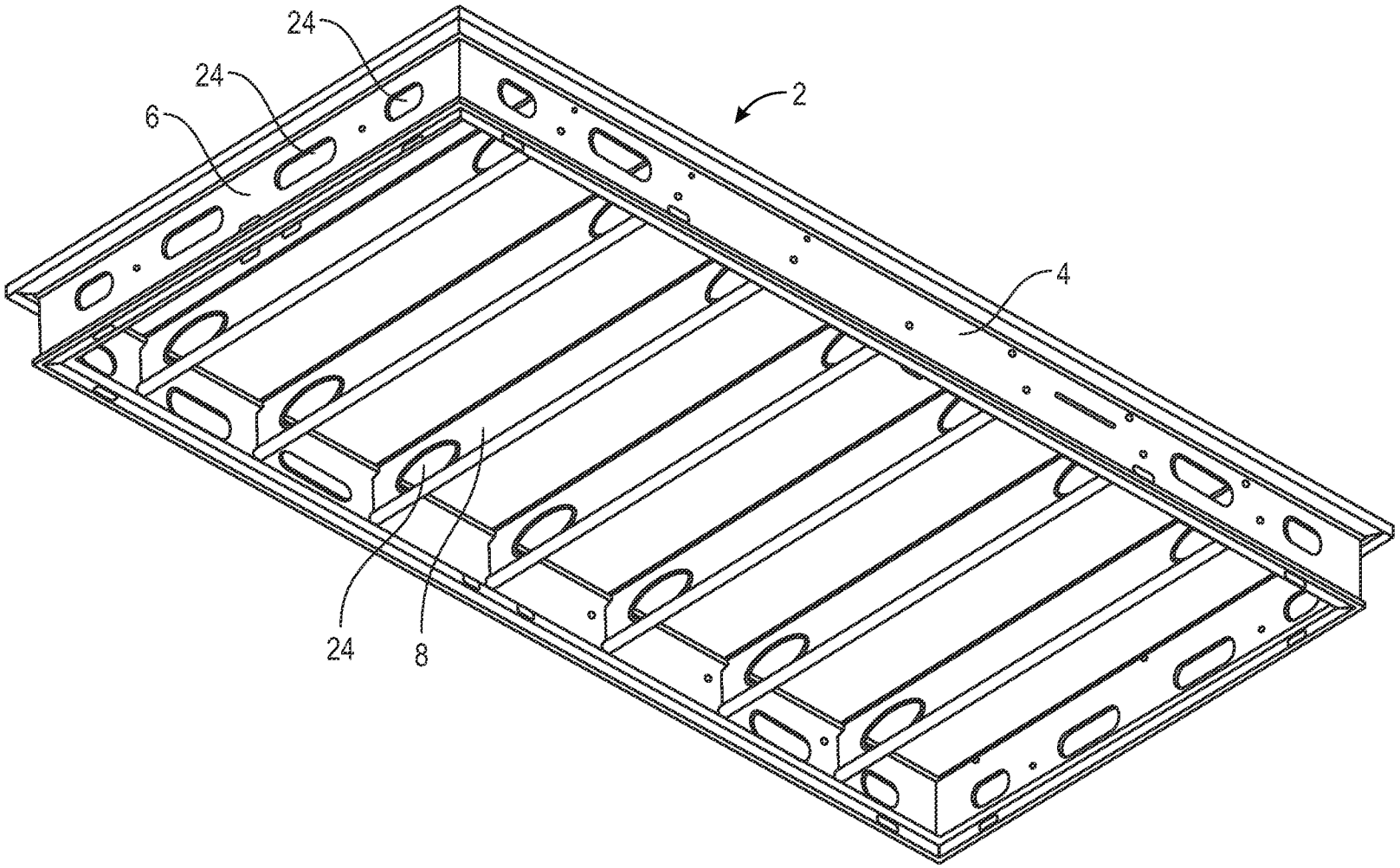
FIG. 1 a support structure for a formwork panel, in a perspective representation and looking obliquely onto its rear side.

The support structure shown in FIG. 1 has two longitudinal edge girders 4, two transverse edge girders 6 and seven transverse girders 8 distributed over the length of the support structure 2 (which, when taking the transverse edge girders 6 into account, are "transverse intermediate girders"). The transverse girders 8 extend from one longitudinal edge girder 4 to the other longitudinal edge girder 4 in an orientation perpendicular to the longitudinal edge girders. The transverse girders 8 are each welded to the two longitudinal edge girders 4. The transverse edge girders 6 also extend from one longitudinal edge girder 4 to the other longitudinal edge girder 4 in a direction perpendicular to the longitudinal edge girders 4 and are welded to the longitudinal edge girders 4 at the four corners of the support structure 2.

All of said girders 4, 6, 8 are made of aluminum.

If a formwork skin is placed on the drawn support structure 2 on its front side (this is the side farther from the viewer of FIG. 1) and fastened to the support structure 2, the result is a frame formwork panel. The drawing of FIG. 1 then looks unchanged because the edge girders 4 and 6 each have an outer, forward-drawn edge so that these four edges cover the four corners of the plate-like formwork skin.

Figure 2:
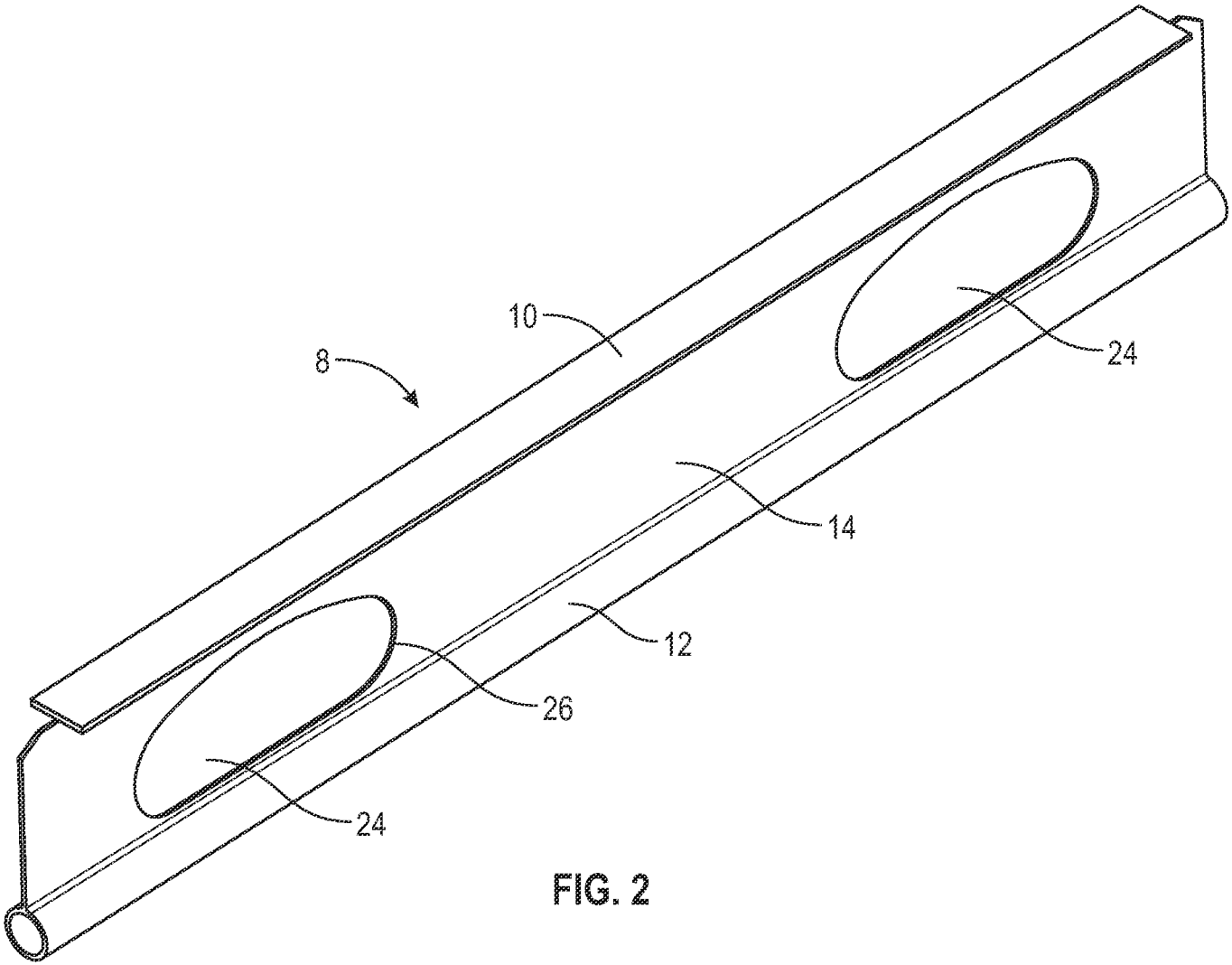
FIG. 2 one of the transverse girders of the support structure of FIG. 1, in a perspective representation looking obliquely onto its front side.

The seven transverse girders 8 all have the same configuration as shown in FIG. 2. The transverse member 8 shown in FIG. 2 is a profiled girder having a flange 10 on the front, a tubular hollow section 12 on the rear and a wall-like member 14 in-between. The flange 10 projects on both sides of the member 14 and is symmetrical to the central plane of the member 14. In the two longitudinal end sections of the profile girder 8, the flange 10 and the front edge of the member 14 are removed a little so that the profile girder 8 fits well into the profile of the longitudinal edge girder 4.

Figure 3:
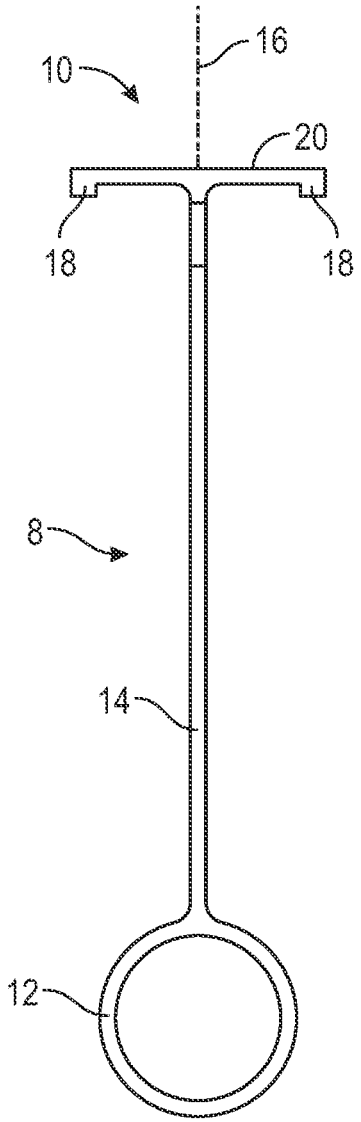
FIG. 3 the transverse girder of FIG. 2, in the cross-section or front view and on a larger scale.
Figure 4:
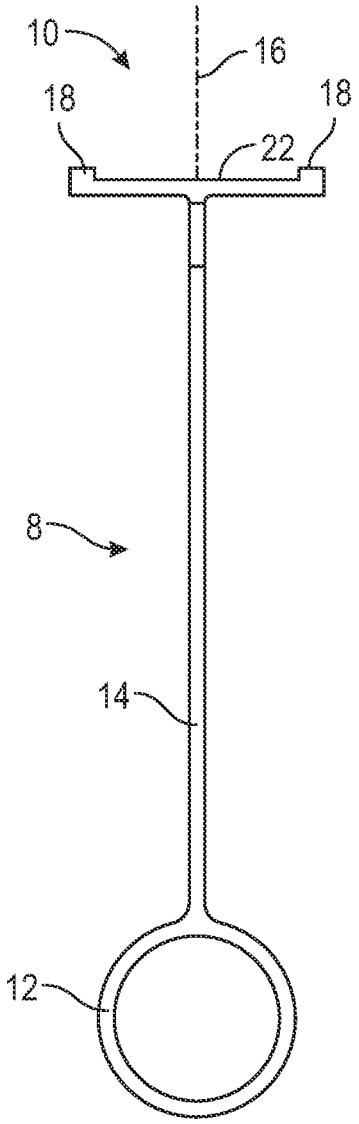
FIG. 4 a modified transverse girder cross-section.

FIG. 3 shows the cross-section of the profile girder 8 on a larger scale. The profile girder 8 is symmetrical to its longitudinal center plane 16, which runs in the middle of the member 14 from the flange 10 to the hollow section 12. The profile girder 8 is an extruded part made of aluminum. The same applies to the longitudinal edge girders 4 and the transverse edge girders 6. The cross-section of the hollow section 12 is circular on the outside (with the exception of the transition to the member 14) and circular on the inside. The member 14 is a narrow rectangle in the cross-section. In the cross-section, the flange 16 is a narrow rectangle (which is perpendicular to the member 14), each having a projection 18 at the left end of the flange 10 in FIG. 3 and at the right end of the flange 10 in FIG. 3. The projections 18 increase the flange thickness there. In FIG. 3, the projections project downwards, i.e., towards the rear in relation to the overall support structure or towards the rear of the support structure 2. In the modification of the profile girder 8, as shown in FIG. 4, the two projections 18 project forward instead.

The profile girder 8 has the following dimensions in the embodiment shown:

Thickness of the member 14: 1.6 mm;

Height of member 14 measured from the hollow section 12 to the flange 10: 73 mm;

Width of the flange 10 in FIG. 3: 25 mm;

Outer width of the hollow section 12 in FIG. 3: 20 mm;

Wall thickness of the hollow section 12: 1.7 mm.

It is emphasized that the front surfaces 20 of all flanges 10 of all transverse girders 8 are located in the same plane as the contact surfaces of the longitudinal edge girders 4 and the transverse edge girders 6 so that a formwork skin attached to the support structure 2 is supported evenly by all the girders 4, 6, 8.

The formwork skin may be fastened, for example with rivets, which are fastened to the support structure 2 by the formwork skin and by the areas of the flanges 10 located between the two projections 18. The type of configuration of the projections 18 shown in FIG. 4 creates a wide groove 22 at the front of the flange 10. It is possible to apply an adhesive layer there to adhere the formwork skin to the transverse girders 8.

FIGS. 1 and 2 show that each profile girder 8 has two finger holes 24 which are elongated in the longitudinal direction of the profile girder 8 and both have the same configuration. The circumferential line of the respective finger hole 24 is rectilinear for almost the entire length of the finger hole and closely adjacent to the line where the outer circumference of the hollow section 12 leads away from the member 14. The front of the circumferential line 26 is curved with a large radius so that the respective finger hole 24 is higher in the middle than at a distance from the center. At the ends of the respective finger hole 24, the rear, rectilinear part and the front, curved part of the contour line 26 substantially merge into one another with essentially circular-arc-shaped sections. Overall, the respective finger hole 24 is so large that a person handling the support structure 2 or the formwork panel produced therewith can comfortably pass one hand through the finger hole 24 and grasp the hollow section 12 with the thumb and fingers. The center of each finger hole 24 is spaced approximately 20% of the length of the profile girder 8 from the adjacent end of the profile girder 8.

FIG. 1 shows that also the longitudinal edge girder 4 and the transverse edge girder 6 each have various holes 24. Some of the holes 24 are finger holes. Other holes 24 are provided for other purposes. The longitudinal edge girders 4 and the transverse edge girders 6 all have the same cross-sectional shape but differ from the cross-sectional shape of the transverse girders 8.

The invention claimed is:

1. A support structure for a formwork panel, comprising:
a pair of oppositely arranged edge girders; and
a plurality of transverse girders between the edge girders which run transversely to the edge girders,
wherein at least some of the transverse girders are designed as a profile girder, comprising a flange at a first end arranged at a front of the support structure, a tubular hollow section having a substantially circular cross-section at a second end away from the front of the support structure, and a wall-like member, between the flange and the tubular hollow section, connecting the first end and the second end,
wherein the at least one profile girder has a finger hole in the member or a plurality of finger holes over the length of the profile girder.

2. The support structure according to claim 1,
wherein the at least one profile girder is an extruded profile made of aluminum.

3. The support structure according to claim 1,
wherein the finger hole, or the finger holes, is or are elongated in the longitudinal extension direction of the profile girder and is or are delimited on the side adjacent to the hollow section by the hollow section for a large part of its or their length.

4. The support structure according to claim 1,
wherein the at least one profile girder has a flange projecting on both sides of the member.

5. The support structure according to claim 1,
wherein the flange has, at its projecting end, or its projecting ends, a projection which increases the thickness of the flange, with the projection projecting forward towards the front of the support structure and/or backward towards the rear of the support structure.

6. The support structure according to claim 1,
wherein the member has a thickness in the range 0.8 to 2.5 mm or in the range 0.8 to 2.0 mm.

7. The support structure according to claim 1,
wherein the member has a height in the range 50 to 110 mm.

8. The support structure according to claim 1,
wherein the flange has a width in the range 15 to 40 mm.

9. The support structure according to claim 1,
wherein the hollow section, measured outside and perpendicular to the central plane of the member, has a thickness in the range 15 to 30 mm.

10. The support structure according to claim 1,
wherein the wall thickness of the hollow section is 0.95 to 1.2 times the wall thickness of the member.

11. The support structure according to claim 1,
wherein the thickness of the flange, is 0.7 to 1.2 times the wall thickness of the member.

12. The support structure according to claim 1, further comprising: a pair of transverse edge girders, each extending transversely to the pair of oppositely arranged edge girders.

13. A formwork panel, comprising:
the support structure according to claim 1; and
a formwork skin attached to the support structure at the support structure front side.

14. The support structure of claim 1, wherein a wall thickness of the hollow section is 0.95 to 1.2 times a wall thickness of the wall-like member.

15. The support structure according to claim 6, wherein the thickness of the flange, excluding the projection, is 0.7 to 1.2 times the wall thickness of the member.

16. A support structure for a formwork panel, comprising:
a pair of oppositely arranged edge girders; and
a plurality of transverse girders between the edge girders which run transversely to the edge girders,
wherein at least some of the transverse girders are designed as a profile girder, comprising a flange at a first end arranged at a front of the support structure, a tubular hollow section at a second end away from the front of the support structure, and a wall-like member, between the flange and the tubular hollow section, connecting the first end and the second end,
wherein at least one of:
the member has a thickness in the range 0.8 to 2.5 mm or in the range 0.8 to 2.0 mm,
the member has a height in the range 50 to 110 mm,
the flange has a width in the range 15 to 40 mm,
the hollow section, measured outside and perpendicular to the central plane of the member, has a thickness in the range 15 to 30 mm, or
the wall thickness of the hollow section is 0.95 to 1.2 times the wall thickness of the member.

17. A support structure for a formwork panel, comprising:
a pair of oppositely arranged edge girders; and
a plurality of transverse girders between the edge girders which run transversely to the edge girders,
wherein at least some of the transverse girders are designed as a profile girder, comprising a flange at a first end arranged at a front of the support structure, a tubular hollow section having a substantially circular cross-section at a second end away from the front of the support structure, and a wall-like member, between the flange and the tubular hollow section, connecting the first end and the second end,
wherein a wall thickness of the hollow section is 0.95 to 1.2 times a wall thickness of the wall-like member.

* * * * *